United States Patent [19]

Münnekehoff

[11] Patent Number: 4,613,089

[45] Date of Patent: Sep. 23, 1986

[54] YARN WINDING APPARATUS

[75] Inventor: Gerd Münnekehoff, Remscheid, Fed. Rep. of Germany

[73] Assignee: Barmag Barmer Maschinenfabrik AG, Remscheid, Fed. Rep. of Germany

[21] Appl. No.: 732,508

[22] Filed: May 9, 1985

[30] Foreign Application Priority Data

May 10, 1984 [DE] Fed. Rep. of Germany ..... 3417258
Dec. 20, 1984 [DE] Fed. Rep. of Germany ..... 3446444

[51] Int. Cl.[4] ..... B65H 54/42; B65H 54/52
[52] U.S. Cl. ..... 242/18 DD; 242/43 R
[58] Field of Search ..... 242/18 DD, 18 R, 43 R, 242/43.2, 65

[56] References Cited

U.S. PATENT DOCUMENTS 3,807,647 4/1974 Miller ..... 242/18 DD
4,006,863 2/1977 Bense ..... 242/18 DD
4,087,055 5/1978 Yasuda et al. ..... 242/18 DD

FOREIGN PATENT DOCUMENTS 744067 6/1970 Belgium ..... 242/18 DD
2039772 3/1972 Fed. Rep. of Germany .
2626504 12/1977 Fed. Rep. of Germany .
1395345 5/1975 United Kingdom ..... 242/18 DD

*Primary Examiner*—Stanley N. Gilreath
*Attorney, Agent, or Firm*—Bell, Seltzer, Park & Gibson

[57] ABSTRACT

An apparatus for winding a high speed running yarn is disclosed, and which comprises a freely rotatable spindle for supporting the yarn packages being wound, and a slide which includes an outwardly extending support arm which is mounted above the spindle and which includes the yarn traversing mechanism and the drive roll for rotating the yarn packages. The slide is vertically movable so as to accommodate the build of the yarn packages on the spindle, and a lever arm is provided for supportingly engaging the support arm of the slide at a medial location along its length to support at least a substantial portion of the weight of the slide and thereby minimize the moment forces acting upon the means mounting the slide to the frame of the apparatus.

14 Claims, 6 Drawing Figures

YARN WINDING APPARATUS

The present invention relates to a yarn winding apparatus for winding a high speed running yarn or the like onto a bobbin tube to form a wound yarn package. The invention is particularly adapted for winding synthetic fibers, such as newly spun and/or drawn multifilament yarns, into packages.

Winding apparatus of the described type typically comprise a winding spindle which coaxially supports one or more bobbin tubes, and a traversing device mounted on a slide above the winding spindle. The winding spindle and slide are movable relative to each other to accommodate the build of the package. This relative movement is preferably achieved by mounting the winding spindle at a fixed location to a frame, while the slide and thus the traversing device is movable relative thereto.

German Offenlegungsschrift No. 20 39 772 describes a winding apparatus in which the traversing device is mounted on a support arm which is part of the slide. The slide is guided along a straight path in an essentially vertical direction, and such that the traversing device is able to move away from the spindle as the diameter of the package being formed on the spindle increases. The weight of the slide and its supporting arm is fully or partly compensated by a force transmitting device, which comprises a pneumatic cylinder piston unit.

It is desirable to be able to form as many packages as possible on the winding spindle, such as for example four packages from four spun yarns leaving a spinning nozzle. It is also desirable to wind as much yarn as possible on each tube, in order to produce the largest possible packages.

It is accordingly an object of the present invention to provide an improved winding apparatus, of the type comprising a winding spindle and an overlying slide support arm which mounts a yarn traversing device, and wherein the support arm is movable with respect to the winding spindle and is maintained parallel to the winding spindle, so that all packages may be uniformly built and preferably have a uniform length.

It is also an object to provide a yarn winding apparatus of the described type where there is low friction between the movement of the slide and its mounting structure so that the slide may withdraw as the packages build without "sticking".

It is a further object of the present invention to provide a yarn winding apparatus of the described type wherein the mounting structure for the slide is subject to only relatively small moment forces caused by the weight of the outwardly extending support arm, to thereby facilitate relative sliding movement between the slide and frame, and further, wherein only one force transmitting device need be employed and which is subject to only small friction forces.

These and other objects and advantages of the present invention are achieved in the embodiments illustrated herein by the provision of a yarn winding apparatus which includes a frame, a winding spindle having one end thereof rotatably mounted to the frame, and a slide comprising an end portion and an outwardly extending support arm which mounts a yarn traverse means. In a preferred embodiment, the slide also mounts drive roll means adapted to operatively engage and rotate the bobbin tubes and packages formed thereon. Means are also provided for mounting the end portion of the slide to the frame with the support arm thereof overlying the spindle, and so as to permit relative sliding movement between the slide and the frame to accommodate the build of a package of each of the tubes mounted on the spindle. In addition, the apparatus includes force transmitting means supportingly engaging the slide at a medial location along the length of the support arm, to support at least a substantial portion of the weight of the slide and thereby minimize the moment force acting upon the mounting means resulting from the weight of the slide, and facilitate relative sliding movement between the slide and frame.

In the preferred embodiment, the force transmitting means includes a lever arm pivotally connected to the frame, and which has one end portion operatively engaging the support arm of the slide at a medial location along the length of the support arm, and preferably adjacent the center of gravity of the slide. Also, there is provided a biasing means in the form of a cylinder piston unit for applying a force to the lever arm tending to pivot the arm in a direction such that the end portion in contact with the slide tends to support at least some of the weight of the slide. The support arm of the slide is thus prevented from exerting an undue bending moment onto the mounting means for the slide, and the support arm itself is not subjected to an undue bending moment force.

The apparatus of the present invention offers the further advantage that the slide is movable along a substantial distance to permit packages of very large diameter to be produced, and the leverage ratio between the movement of the slide and the movement of the force transmitting device may be selected so that the movement of the force transmitting means is relatively small, which is advantageous insofar as friction, wear, and the use of space are concerned.

In one preferred embodiment, the lever arm is essentially straight, and the force transmitting means acts on the portion between the pivot on the machine frame and the longitudinal center of the lever arm, while the free end of the lever arm engages the slide.

In another embodiment, the lever arm comprises two arm segments disposed at right angles to each other, and the arm is pivotally mounted to the frame at the intersection of the two arm segments. Also, in this embodiment, one arm segment engages the support arm of the slide and the force transmitting means engages the other arm segment. This arrangement permits the length of the frame of the winding apparatus to be minimized.

The force transmitting means of the present invention preferably comprises a hydraulic or pneumatic cylinder piston unit. The cylinder piston unit is operated by a pressure, which may be constant, or varied during the winding of the package. The cylinder piston unit thus absorbs part of the weight of the slide, including the outwardly extending arm, the traversing device, etc. This offers the advantage that all traversing devices will have the same distance from the spindle and packages formed thereon such that packages of uniform shape and dimensions will be built. Furthermore, if a drive roll is used, the drive roll, which is also mounted to the support arm of the slide, contacts the packages being formed on the spindle only with a limited, predetermined pressure, which may vary during the package winding operation.

In order to provide the most compact type of construction, the mounting for the slide includes a straight guide, for example a cylindrical post which is fixedly mounted to the frame, and a sleeve slideably mounted on the post, with the sleeve being fixed to the slide.

In order to provide the slide and its outwardly extending support arm with a high degree of stability, the slide may be guided along two fixed guides, which are positioned at diagonally opposite corners of the end portion of the slide, when viewed in plan view. This provides the greatest possible distance between the guides.

In one preferred embodiment, the point of contact between the lever arm and the support arm is movable in the longitudinal direction, and to this effect, the free end portion of the lever arm and the support arm of the slide contact each other by means of a slide bearing surface on the support arm. In another embodiment, the support arm of the slide and the lever are connected to each other by an intermediate lever which is pivoted at one end to the support arm of the slide and at its other end to the lever arm.

Alternatively, the lever arm may be pivoted at a fixed location on the support arm, and the lever arm may be movably mounted with respect to the frame. To this effect, the pivot of the lever arm may be mounted in a sliding bearing, and in an especially simple embodiment, the pivot of the lever arm is fixed to one end of an intermediate lever, which is in turn pivotally mounted to the frame at its other end.

The force transmitting means may also be movable with respect to the lever arm, transversely to its direction of movement. For this purpose, the force transmitting means may be mounted for pivoting movement, or the force transmitting means and the lever arm may be connected to each other by means of an intermediate lever, which is pivotally connected to each member.

Some of the objects having been stated, other objects will appear as the description proceeds, when taken in connection with the accompanying drawings in which FIG. 1 is a side elevation view, partly sectioned, of a yarn winding apparatus which embodies the features of the present invention;

Figure 1:
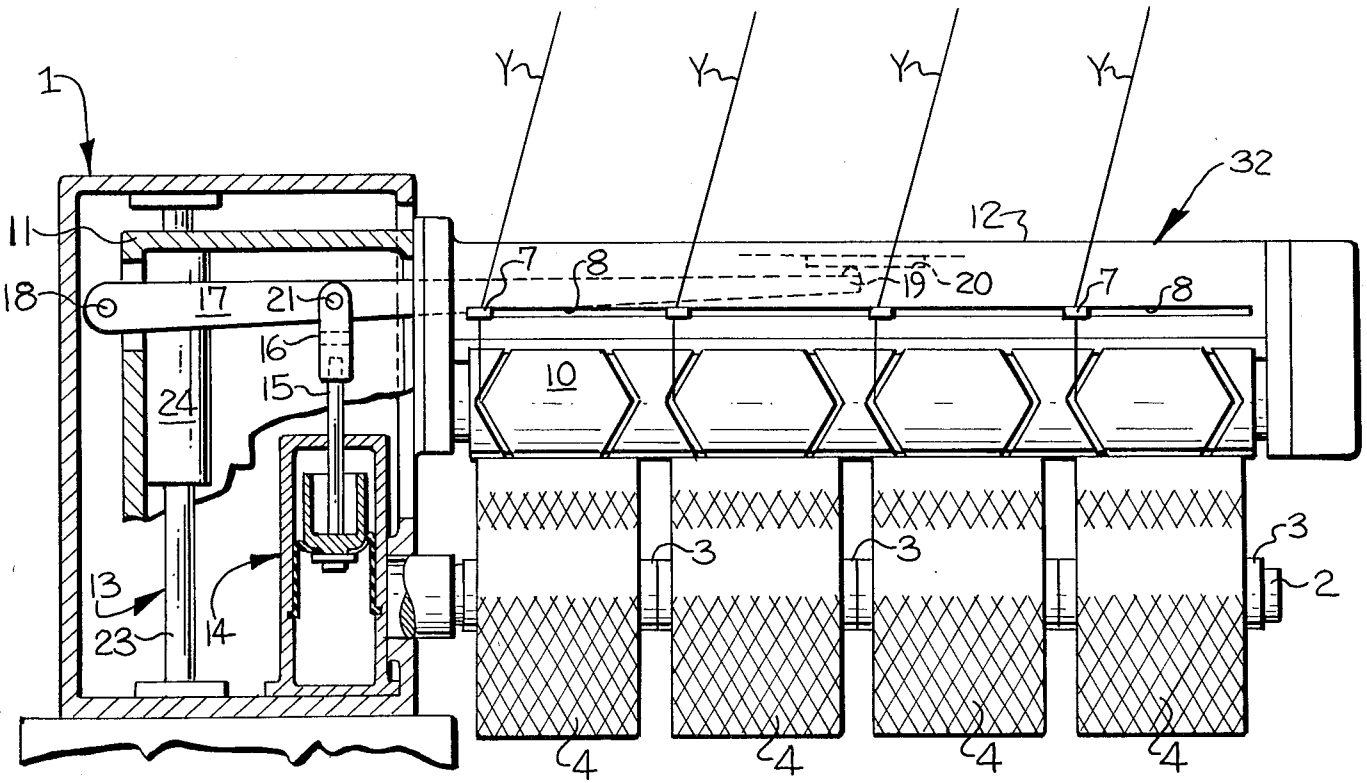

Referring more particularly to the drawings, FIG. 1 shows a yarn winding apparatus which includes a supporting frame 1, which mounts an elongate winding spindle 2 for free rotation about a fixed axis. More particularly, one end of the spindle is rotatably mounted to the frame 1, and the spindle extends horizontally and outwardly from the frame in cantilever fashion, and so as to be adapted to coaxially mount four bobbin tubes 3 in the illustrated embodiment. A wound package 4 is thus adapted to be formed on each tube 3.

A slide 32 is mounted for sliding vertical movement with respect to the frame 1. The slide 32 includes a mounting end portion 11 shown at the left side in FIG. 1, and an outwardly directed support arm 12 which is disposed parallel to and above the spindle 2 cantilevered fashion. The arm 12 of the slide mounts a drive roll 5 (note FIG. 3), a yarn traversing device 6 by which the four yarns Y are reciprocated onto the associated packages 4. Each traversing device comprises a yarn guide 7, which is driven by a cross spiralled roll 9 so as to reciprocate along the straight guide slot 8. Also, a grooved roll 10 is provided which has grooves formed therein (note FIG. 3). However, any other type of traversing device may be used with the present invention, for example a so-called rotary blade yarn traversing system as described for example in U.S. Pat. No. 4,505,436 to Schippers et al. The drive means for rotating the drive roll and the traversing device are conventional, and are not shown in the drawings for clarity of illustration.

The end portion 11 of the slide 32 is slideably mounted to the frame 1 by a pair of mounting guides 13, with each mounting guide comprising a vertical post 23 and surrounding sleeve 24. More particularly, the vertical posts 23 are fixed to the frame, and are mounted at diagonally opposite corners of the end portion 11, note FIG. 5. In addition, the end portion 11 mounts the sleeves 24 for slideably engaging each of the posts. Thus the traversing device and the drive roll are able to withdraw from the spindle 2, as the diameter of the packages 4 increases.

The apparatus of the present invention further comprises force transmitting means supportingly engaging the support arm 12 at a medial location along its cantilevered longitudinal length to support at least a substantial portion of the weight of the slide 32, and thereby prevent the entire weight of the slide, including the end portion 11, arm 12, traversing device 6, and drive roll 5, from resting upon the packages. By this arrangement, the moment force acting upon the mounting means of the slide and caused by the weight of the above mentioned components is minimized, to thereby avoid canting of the slide upon its mounting means and thus facilitate the relative sliding movement between the slide and frame.

In the embodiment of FIG. 1, the force transmitting means comprises a lever arm 17 which is pivotally connected to the frame by a pin 18, and the lever arm 17 has an opposite free end portion 19 which engages a slide bearing surface 20 on the support arm 12. In addition, there is provided a force transmitting device 14, which comprises a cylinder piston unit of a well-known design, and which includes a piston rod 15 which is pivotally connected to the lever arm 17 via an intermediate linkage 16 and pivot pin 21. The distance between the pivot pin 18 and the pivot pin 21 on which the force transmitting device 14 acts, and the distance between the pin 21 and the end portion 19 of the lever arm, is predetermined together with the length of the stroke of the force transmitting device, such that the support arm 12 is able to perform the desired upward movement which is necessary to accommodate the desired maximum diameter of the packages, and which also permits the drive roll to withdraw from the surfaces of the full packages. Also it will be apparent from the drawings that the ratio of the length of the lever arm between the pivotal connection at pin 18 and the end portion 19 to the length of the lever arm between the pivotal connection at pin 18 and the pin 21 at which the biasing force is applied to the lever arm, is substantially equal to the ratio of the length of the movement of the slide to the length of the movement of the piston rod 15 of the force transmitting device 14. The slide bearing surface 20 is positioned in about the longitudinal center of the support arm 12, and preferably in about the longitudinal center of gravity of the entire slide 32, consisting of the end portion 11 and arm 12. It is not however imperative that the slide bearing surface 20 be arranged exactly at the longitudinal center of gravity, since the guides 13 will in any event be able to absorb certain moment forces without difficulty. However, it is desirable that the arrangement avoid an unduly high bending moment force on the end portion 11 and the mounting guides 13.

By reason of the slide bearing 20, the end portion 19 of the lever arm is able to move in the longitudinal direction with respect to the arm 12. This degree of freedom is necessary where the lever arm pivots about the pivot pin 18. The intermediate linkage 16, which is pivoted on its one end to the piston rod 15, and on its other end to the lever at pivot pin 21, serves to ensure the mobility of the pivot point in the longitudinal direction with respect to the piston rod 15.

Figure 3:
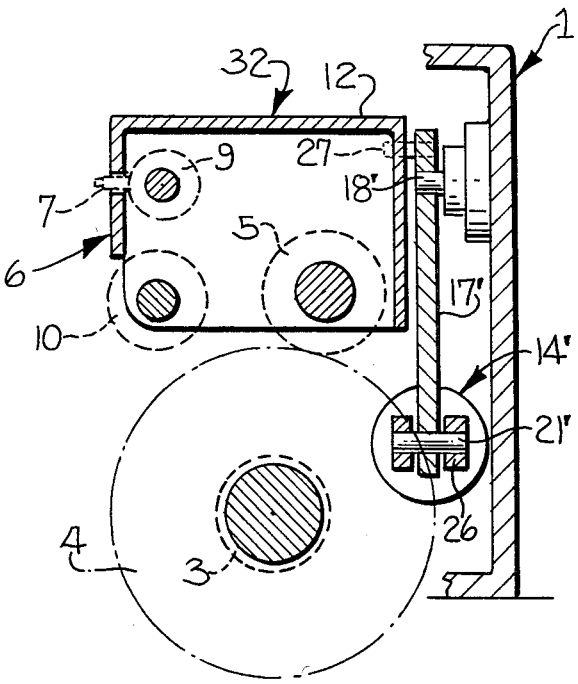
FIG. 3 is a sectional end view of the embodiment shown in FIG. 2.
Figure 4:
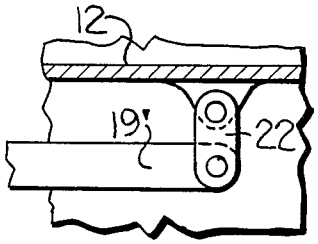
FIG. 4 is a fragmentary sectional view illustrating one embodiment of the interconnection between the lever arm and support arm of the slide.

As shown in FIG. 4, the end 19' of the lever arm 17 may alternatively be connected to the support arm 12 by means of an intermediate lever 22. The intermediate lever 22 is pivoted at one end to the support arm 12, and at its other end to the lever arm 17, which permits a relative movement in the longitudinal direction of the support arm 12. It should be mentioned that this embodiment may also be applied to the embodiments described below with respect to FIGS. 2, 3 and 5. Also, in this embodiment the winding spindle 2 with the bobbin tubes 3 clamped thereon, are rotatably mounted in the stationary frame 1 of the winding apparatus, and are driven by the drive roll 5. The yarn guide 7 is reciprocated along the straight guide slot 8 by the cross spiralled roll 9, and the yarn guide 7 is followed, when viewed in the direction of the running yarn Y, by a grooved roll 10 by which the yarn is wound on the tube. The traversing device 6 with the cross spiralled roll 9, yarn guide 7 and grooved roll 10 and drive roll 5, are all mounted to the support arm 12 of the slide 32. The support arm 12 extends outwardly in a direction parallel to the winding spindle and accommodates the necessary bearings.

During the build of the packages, the slide 32 moves upwardly along the straight mounting guides 13. The posts 23 of the guides 13 are fixed to the frame, and the sleeves 24 slide along the posts 23, which may include intermediate rollers or balls, so as to reduce the play and friction as much as possible during this sliding movement. As can be seen from FIG. 5, two mounting guides 13 are provided at the corner points of the diagonal of the end portion 11 of the slide, so that a stable guidance of the slide is ensured. The slide may also be moved in a vertical direction by means of the lever arm 17. The lever arm 17 is essentially straight in the embodiment of FIG. 1, and includes an end portion 19 which is in sliding contact with the bearing surface 20 of the supporting arm 12.

Figure 2:
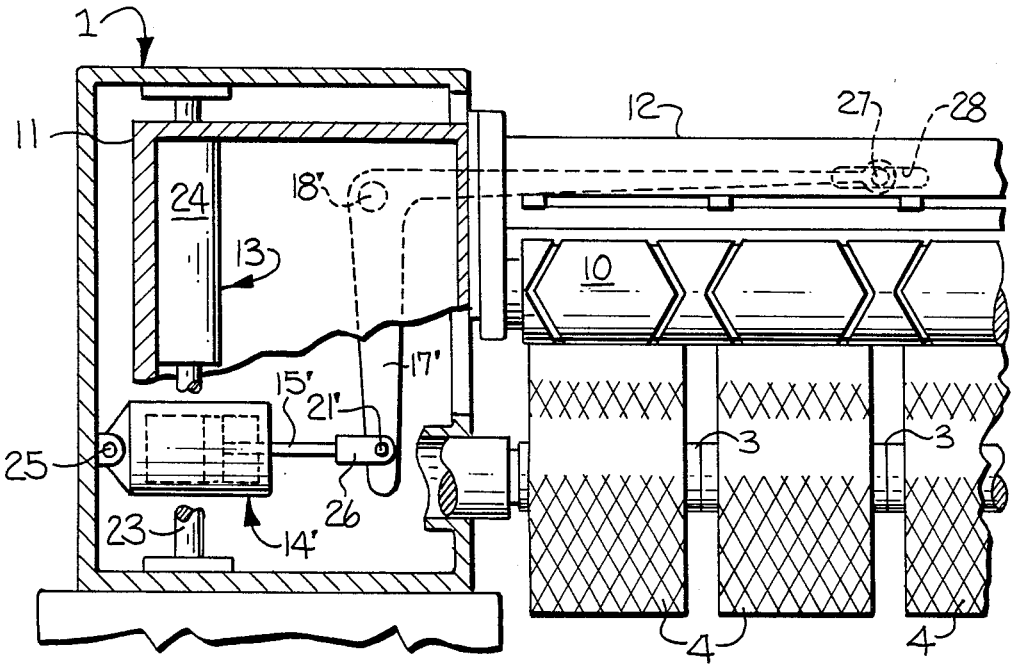
FIG. 2 is a view similar to FIG. 1, and illustrating a second embodiment of the invention.
Figure 5:
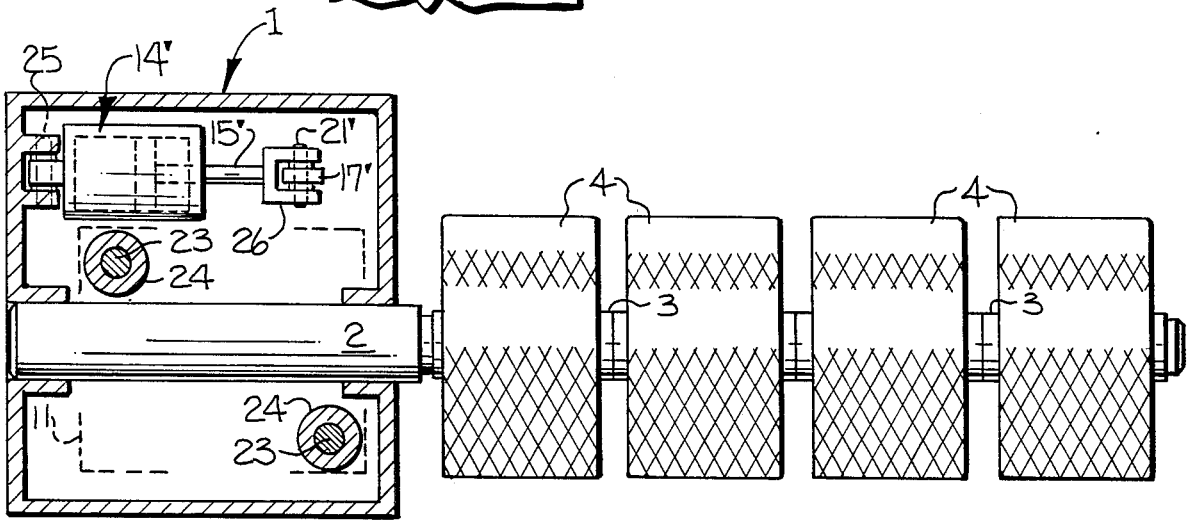
FIG. 5 is a sectional top plan view of the winding apparatus shown in FIG. 2.

In the embodiment of FIGS. 2, 3, and 5 the sliding bearing is in the form of a slot 28 which extends in the supporting arm 12 in the longitudinal direction, and into which a pin 27 of the lever arm 17' laterally projects. The lever arm of this embodiment comprises two arm segments disposed at right angles to each other, and the lever arm is pivotally mounted to the frame at the intersection of the two arm sections. As best seen in FIG. 3, the lever arm 17' is pivotally mounted at the side of the slide 32 by means of a fixed pivot pin 18' in the frame 1. The vertical arm section is engaged by the force transmitting device 14' at the pivot pin 21'. Also, the force transmitting device 14' is mounted to a pivot pin 25 for pivotal movement, to ensure the mobility of the pivot point at 21' during pivotal movement of the lever arm 17'. FIG. 5 illustrates that the piston rod 15' is interconnected to the pivot pin 21' of the lever arm 17' by means of a U-shaped yoke 26.

Figure 6:
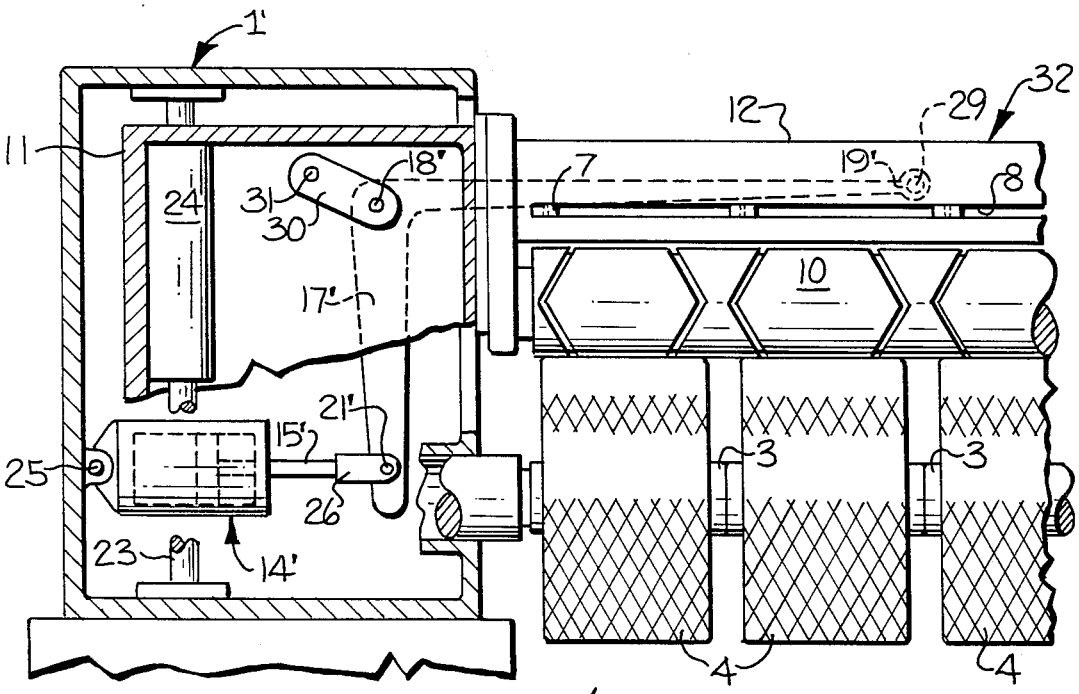
FIG. 6 is a view similar to FIG. 2, and illustrating a further embodiment of the invention.

FIG. 6 illustrates an embodiment of the invention which is similar to that shown in FIGS. 2, 3, and 5 and which also comprises a winding spindle 2 having bobbin tubes 3 coaxially mounted thereon, and so that the packages 4 are rotatably mounted with respect to the frame 1. The packages are driven by the drive roll 5, and the yarn guide 7 is reciprocated along the guide slot 8 by a cross spiral roll 9. The yarn guide 7 is followed, when viewed in the direction of the running yarn, by a grooved roll 10 by which the yarn is wound on the tube. The traversing device 6 with the cross spiralled roll 9, yarn guide 7 and grooved roll 10, and drive roll 5 with its drive (not shown) are all mounted on the arm 12 of the slide 32. Also, the supporting arm 12 extends longitudinally in a direction parallel to the winding spindle and accommodates the bearings.

The slide 32 of FIG. 6 moves along the straight mounting guides 13, which comprise the posts 23 and coaxial sleeves 24. The posts 23 are fixed to the frame 1, while the sleeves 24 slide along the posts 23. If desired, suitable rollers or balls may be disposed between the posts 23 and sleeves 24, to maintain the play and friction as low as possible during this sliding movement. As best seen in FIG. 5, the two guides are mounted at the corner points of the diagonal of the end portion 11, and thus the guides are disposed along a diagonal in plan view with respect to the longitudinal direction of the arm 12. A stable guidance of the slide 11 and supporting arm 12 is thereby assured.

The slide 32 is movable in a vertical direction by means of the lever arm 17'. The end portion 19' of the lever arm 17 acts upon the support arm 12 via a stationary hinge pin 29, and the lever arm 17' is mounted at the side of the slide 32 by means of a pivot pin 18'. This pivot pin 18' is arranged at the end of an intermediate lever 30, and the intermediate lever 30 is pivotable at one end about a pin 31 in the frame, and is pivotable at the other end about the pivot pin 18'. The pivot pins 18' and 31 are positioned at least approximately on the resultant of the forces exerted on the lever arm by the pin 29, and by the force transmitting device 14' at the point 21'.

The other end of the lever arm 17' of FIG. 6, is disposed vertically, and this end is acted upon by the force transmitting device 14' at the pivot pin 21'. The force transmitting device 14' is mounted by means of a pivot pin 25, in order to ensure the mobility of the pivot pin 21' during the pivotal movement of the lever arm 17'.

In the drawings and specification, there has been set forth preferred embodiments of the invention, and although specific terms are employed, they are used in a generic and descriptive sense only and not for purposes of limitation.

That which is claimed is:

1. An apparatus for winding a high speed running yarn or the like, and comprising a frame, a winding spindle having one end thereof rotatably mounted to said frame so as to extend outwardly in a longitudinal direction and so as to be adapted to coaxially mount at least one bobbin tube thereon, a slide comprising an end portion and a support arm extending outwardly in a longitudinal direction from said end portion, and with said support arm mounting yarn traverse means, means mounting said end portion of said slide to said frame with said support arm overlying said winding spindle in cantilever fashion, and so that said yarn traverse means is adapted to operatively engage and traverse a yarn on each of said bobbin tubes mounted on said spindle and rotated therewith to form a wound package thereon, and with said mounting means permitting relative sliding movement between said slide and said frame to accommodate the build of a package on each of the bobbin tubes on said spindle, and force transmitting means supporting at least a substantial portion of the weight of said slide, said force transmitting means engaging said support arm of said slide at a medial location along its cantilevered longitudinal length to thereby minimize the moment force acting upon said mounting means of said slide resulting from the weight distribution of said slide and the outwardly extending support arm, and thereby also facilitate relative sliding movement between said slide and said frame.

2. The apparatus as defined in claim 1 wherein said force transmitting means comprises a lever arm pivotally connected to said frame and having one end portion operatively engaging said support arm of said slide, and biasing means for applying a force to said lever arm tending to pivot said lever arm in a direction such that said one end portion thereof supports at least some of the weight of said slide.

3. The apparatus as defined in claim 2 wherein said one end portion of said lever arm engages said slide at a location closely adjacent the longitudinal center of gravity of said slide.

4. The apparatus as defined in claim 2 wherein said lever arm is essentially straight and is pivotally mounted to said frame at the end portion opposite said one end portion, and wherein said biasing means engages said lever arm at an intermediate location along its length.

5. The apparatus as defined in claim 2 wherein said lever arm comprises two arm segments disposed at right angles to each other, and wherein said lever arm is pivotally mounted to said frame at the intersection of said arm segments, with a first one of the arm segments including said one end portion operatively engaging said support arm of said slide, and with said biasing means engaging the other one of said arm segments.

6. The apparatus as defined in claim 2 wherein the ratio of the length of said lever arm between the pivotal connection and said one end portion to the length of said lever arm between the pivotal connection and the point at which the biasing force is applied to said lever arm is substantially equal to the ratio of the length of the movement of said slide to the length of the movement of said biasing means.

7. The apparatus as defined in claim 2 wherein said biasing means comprises a hydraulic or pneumatic cylinder piston unit.

8. The apparatus as defined in claim 2 wherein said means mounting said end portion of said slide to said frame includes at least one post and surrounding sleeve.

9. The apparatus as defined in claim 2 wherein said means mounting said end portion of said slide to said frame includes a pair of posts mounted to one of either said slide end portion or said frame, and a sleeve closely surrounding each post and mounted to the other of said slide end portion or said frame.

10. The apparatus as defined in claim 9 wherein the pair of posts and sleeves are disposed along a diagonal in plan view with respect to the longitudinal direction of said slide support arm.

11. The apparatus as defined in claim 2 wherein said support arm of said slide includes a bearing surface adapted for contact with said one end portion of said lever arm.

12. The apparatus as defined in claim 2 wherein said one end portion of said lever arm is pivotally connected to an intermediate lever, and said intermediate lever is pivotally connected to said support arm of said slide.

13. The apparatus as defined in claim 2 wherein said lever arm is pivotally interconnected to an intermediate lever, and said intermediate lever is pivotally connected to said frame.

14. The apparatus as defined in claim 2 further comprising a roll mounted to said support arm and adapted to lie upon the surface of each of the bobbin tubes or packages mounted on said winding spindle.

* * * * *